US006523681B1

(12) United States Patent
Hacikyan

(10) Patent No.: US 6,523,681 B1
(45) Date of Patent: Feb. 25, 2003

(54) ABSORBENT/ADSORBENT PADS

(75) Inventor: Michael Hacikyan, Buffalo, NY (US)

(73) Assignee: Technicor, Inc., Amherst, NY (US)

( * ) Notice: Subject to any disclaimer, the term of this patent is extended or adjusted under 35 U.S.C. 154(b) by 0 days.

(21) Appl. No.: 09/558,982

(22) Filed: Apr. 27, 2000

Related U.S. Application Data

(60) Provisional application No. 60/184,917, filed on Feb. 25, 2000.

(51) Int. Cl.[7] ..... B65D 81/26

(52) U.S. Cl. ..... 206/204; 206/524.4

(58) Field of Search ..... 206/204, 484, 206/484.2, 524.1, 524.2, 524.4, 524.5, 807, 438; 383/5, 109, 113

(56) References Cited

U.S. PATENT DOCUMENTS

| | | | | |
|---|---|---|---|---|
| 2,345,872 A | | 8/1944 | Mitnick | |
| 3,441,023 A | | 4/1969 | Rijssenbeek | |
| 3,621,994 A | | 11/1971 | Brown | |
| 3,990,872 A | | 11/1976 | Cullen | |
| 4,578,070 A | | 3/1986 | Holtman | |
| 4,748,069 A | | 5/1988 | Cullen | |
| 4,758,241 A | | 7/1988 | Papajohn | |
| 4,776,463 A | | 10/1988 | Press | |
| 4,853,266 A | | 8/1989 | Cullen | |
| 4,861,632 A | * | 8/1989 | Caggiano | 206/204 |
| 4,927,010 A | * | 5/1990 | Kannankeril | 206/204 |
| 4,969,750 A | | 11/1990 | Russo et al. | |
| 4,984,907 A | * | 1/1991 | Power | 206/204 |
| 5,069,694 A | | 12/1991 | Cullen et al. | |
| 5,251,744 A | | 10/1993 | Dziersk et al. | |
| 5,279,421 A | | 1/1994 | Gouge et al. | |
| 5,284,621 A | | 2/1994 | Kaufman | |
| 5,330,047 A | | 7/1994 | Gouge et al. | |
| 5,691,015 A | | 11/1997 | Tsukamoto et al. | |
| 5,728,083 A | | 3/1998 | Cohen et al. | |
| 5,827,586 A | | 10/1998 | Yamashita et al. | |
| 5,882,116 A | * | 3/1999 | Backus | 206/807 |
| 5,984,087 A | * | 11/1999 | Hacikyan | 206/204 |
| 5,996,787 A | | 12/1999 | Kobayashi | |
| 6,161,687 A | * | 12/2000 | Hacikyan | 206/204 |

FOREIGN PATENT DOCUMENTS

| | | |
|---|---|---|
| DE | 3624410 A1 | 1/1988 |
| EP | 0526148 A1 | 3/1993 |
| EP | 1127804 A2 | 8/2001 |
| FR | 682144 | 9/1929 |
| FR | 1394113 | 2/1965 |
| WO | WO 00/06463 | 2/2000 |
| WO | WO 00158764 A2 | 8/2001 |

OTHER PUBLICATIONS

Communication—European Search Report; EP 01301743; 9 pages.

* cited by examiner

*Primary Examiner*—Luan K. Bui
(74) *Attorney, Agent, or Firm*—Hodgson Russ LLP

(57) ABSTRACT

The present invention relates to a packaging unit designed to absorb and/or adsorb liquid that is being transported or was spilled or was released. The packaging unit has at least one sealing multi-layer comprising a first water soluble film and an absorbent/adsorbent material. When the liquid contacts the water soluble film, the liquid passes through the water-soluble film. When the liquid contacts the absorbent/adsorbent material, the absorbent/adsorbent material immobilizes the liquid material. This immobilization prevents the liquid from escaping from the packaging container.

28 Claims, 9 Drawing Sheets

ABSORBENT/ADSORBENT PADS

CLAIMED PRIORITY

The present patent application relies on the priority of U.S. Provisional Patent Application Ser. No. 60/184,917, filing date of Feb. 25, 2000.

FIELD OF THE INVENTION

The present invention relates to a novel adsorbent/absorbent material that is used in association with packaging systems and/or a cleaning pad for industrial and medical applications.

BACKGROUND OF THE INVENTION

Prior attempts to control leaking materials have been disclosed in U.S. Pat. No. 4,749,600 (Inventors: Cullen et al.). Cullen et al. disclose a packet for absorbing and immobilizing a liquid. The packet looks like a sugar packet (See FIG. 3 of the '600 patent) by having an outer layer and inner contents. When the packet is to be used, it is inserted within an outer container, like a Federal Express package. In most instances, the packet falls to the bottom edge, in particular a corner, of the outer container. See Col. 2, lines 46 of the '600 patent. Along with the packet, an inner container of a liquid, like a test-tube of blood (See FIG. 5 of the '600 patent) is inserted into the outer container. According to the '600 patent, the bottom edge of the inner container should contact the packet. Thus, when the blood spills from the inner container, the blood may contact the packet.

If the blood contacts the packet, the blood dissolves the outer layer. The packet has an inner layer of polyvinyl acetate and an outer layer of starch paper or any other liquid-degradable material. The polyvinyl acetate has to be the inner layer in order for the packet to be formed. See col 2, lines 9–11 of the '600 patent.

When the outer layer dissolves, the inner contents are released and form a gel-like substance by absorbing the blood. The inner content is sodium polyacrylate having the formula (C3H3O2Na)n. It is obtainable under the trademark WATER LOCK J-550 from Grain Processing Corporation.

A problem with the Cullen et al. attempt to immobilize a liquid, is that the packet is so small that it is possible that the liquid may never contact the packet. For example, if the packet is located at the bottom of the outer container, as Cullen et al. suggest, and the liquid leaks to the top of the outer container, the packet will never immobilize the liquid since the liquid never contacts the packet. Thereby, the liquid spills from the outer container and provides little protection to the handler of the package. These results could be extremely deleterious to the handler. For example, if the liquid is HIV contaminated and that liquid contacts a cut on the handler, that handler could become infected. This problem is solved by the present invention.

A closer reference is U.S. Pat. No. 5,984,087, assigned to Technicor, Inc.—the owner of this application. In the '087 patent, the invention "relates to a packaging container designed to transport an inner container containing a liquid. The packaging container has at least one sealing multi-layer comprising a first water soluble film and an absorbent material. The inner layer of the packaging container is the water-soluble film that forms the boundary between the cavity that hold the inner container and the packaging container. When the liquid leaks from the inner container while in the packaging container, the liquid dissolves the water-soluble film. When the film is dissolved, the absorbent material is released to absorb and immobilize the liquid material. This immobilization prevents the liquid from escaping from the packaging container." Abstract of the Invention. The present invention discloses another embodiment of that invention which was not fully disclosed in the '087 patent.

SUMMARY OF THE INVENTION

The present invention relates to a packaging unit designed to absorb and/or adsorb liquid that is being transported or was spilled or was released. The packaging unit has at least one sealing multi-layer comprising a first water soluble film and an absorbent/adsorbent material. When the liquid contacts the water soluble film, the liquid passes through the water-soluble film. When the liquid contacts the absorbent/adsorbent material, the absorbent/adsorbent material immobilizes the liquid material. This immobilization prevents the liquid from escaping from the absorbent/adsorbent material.

DETAILED DESCRIPTION OF THE PRESENT INVENTION

U.S. Pat. No. 5,984,087, which is commonly assigned, is hereby incorporated by reference.

Figure 1:
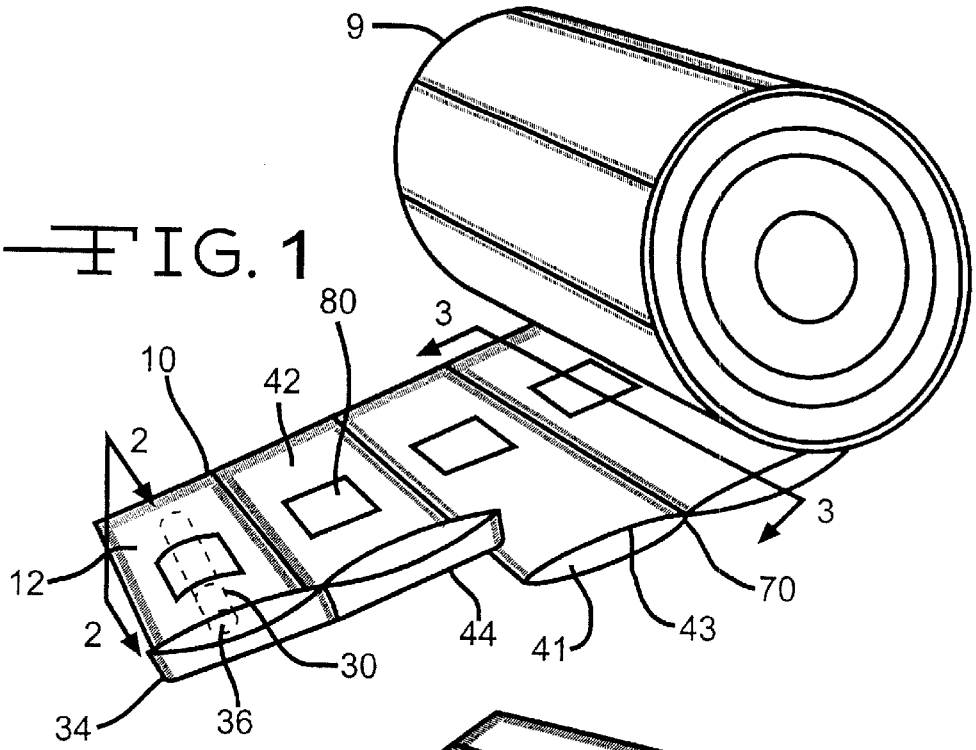
FIG. 1 is a perspective view of a plurality of packaging containers.

One version of the packaging container 10 for adsorbing/adsorbing and immobilizing a liquid (not shown) is shown at FIG. 1. In this embodiment, the container 10 is within a roll 9 with a plurality of other containers 10. Each container 10 includes a multi-layer film wherein the outer layer 12 is shown. The outer layer 12 is any suitable material such as paper, cardboard, wood, or plastic, but preferably a water-insoluble material. Examples of some water-insoluble materials that can be used for the outer layer 12 include thermoplastic resin films, laminated films prepared from two or more thermoplastic resin films, and laminated films prepared from a thermoplastic resin film and paper, metallic foil, woven fabric or unwoven fabric. Preferable thermoplastic resins include polymers and copolymers of olefins, such as ethylene, propylene, butene, pentene, hexene, and the like; polymers and copolymers of vinyl compounds such as vinyl chloride, vinylidene chloride, vinylacetate, vinyl alcohol, acrylic ester, methacrylic ester, acrylonitrile, styrene and the like, polymers of diolefins such as butadiene, isoprene, and the like; copolymers of the above-mentioned olefins, or vinyl compounds; polyamides; and polyesters such as polyethylene terephthalate and the like.

Figure 14:
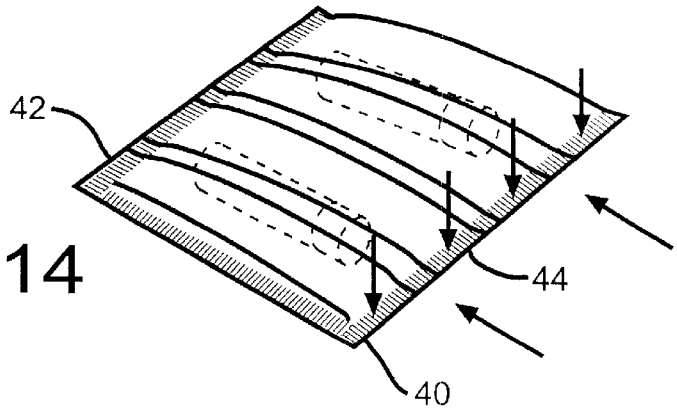
Figure 15:
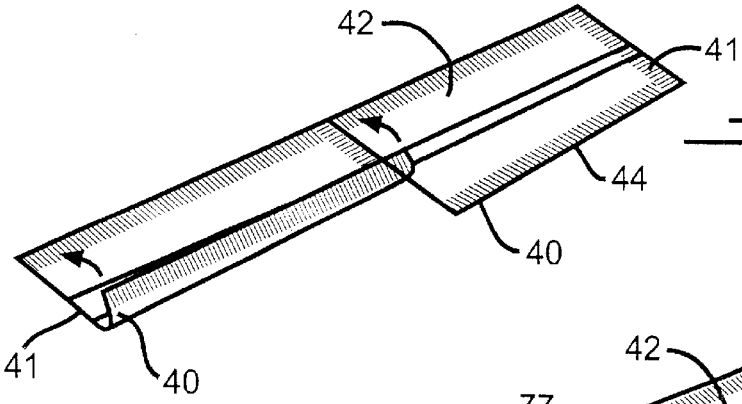

The container 10 has at least two sides—a top side 42 and a bottom side 44. The bottom side 44 is either the same length as the top side 42, as shown in FIG. 1, or longer than the top side 42, as shown in FIGS. 14 and 15, so the bottom side 44 has a flap 40. The flap 40 is designed to fold over onto a portion of the top side 42, as shown in FIG. 15. In contrast, when the bottom side 44 is the same length as the top side 42, the bottom side 44 connects to the top side 42 as shown in FIG. 17*a*.

Figure 2:
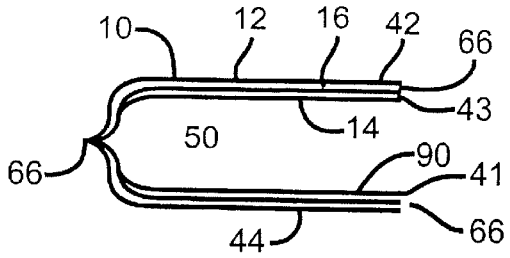
FIG. 2 is a cross-sectional view of FIG. 1 taken along the line 2—2.
Figure 3:
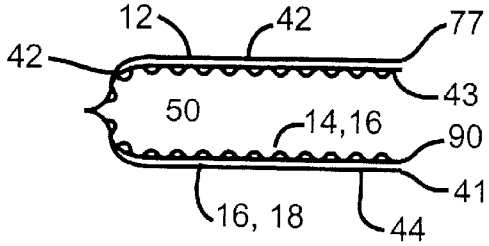
Figure 10:
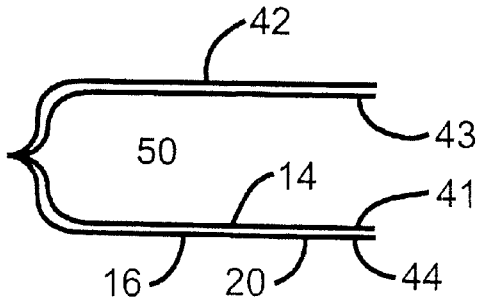
Figure 11:
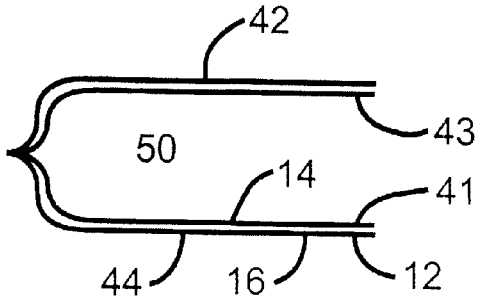

In either embodiment, the inner layer 41 of the flap 40 contacts the top side 42 by various conventional methods. One method, which is shown in FIGS. 2–9, uses a conventional sealant material 90. Such a sealant material 90 includes polyvinyl acetate, ethylvinyl acetate or glue. These sealant materials 90 can be film-like as shown in FIG. 2 or a dot matric coating as shown in FIG. 3. In any case, these sealant materials 90 adhere to the top side 42 and/or underside 43 of the top side 42 by conventional sealing processes, such as crimping, adhesive, pressure sealing, or heat sealing to ensure the package 10 is tamper resistant and impact resistant. Alternatively, the material need not have an adhesive 90 thereon if the material will be crimped, as shown in FIGS. 10–11.

Figure 16:
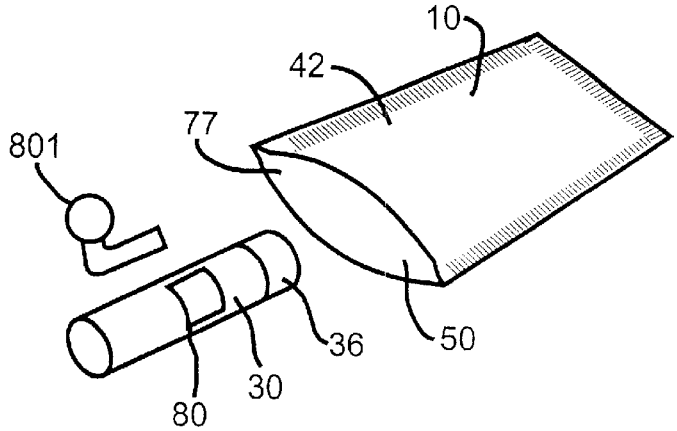
Figure 17:
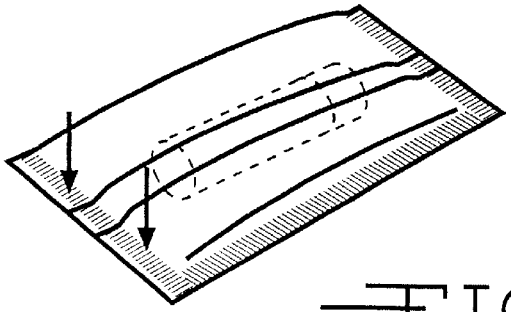

Another method to seal the package container 10, and make it tamper resistant and impact resistant, is merely heat sealing or pressure sealing the edges of the package 10 together with the tab 40 as shown in FIGS. 14–15, or without a tab 40 as shown in FIGS. 16–17.

Reverting to FIG. 1, the packaging container 10 is used to transport liquids or gelatin materials, hereinafter liquid material (not shown), from one place to another. The liquid material (not shown) can be a biological, a radioactive, a pesticide, and/or a chemical agent.

A vial 30 contains the liquid (not shown). The vial 30 is any type of container that can securely hold the liquid material (not shown) and fit within the container 10. The vial 30 can be a rigid material such as glass, metallic, ceramic, plastic or the like, or a flexible material like a conventional flexible plastic material. The vial 30 should be sealable for transportation purposes. An example of the seal includes a cap 36 which holds the liquid (not shown) sealed within the vial 30. Sometimes, the liquid (not shown) leaks from the vial 30. When this occurs, the inner layer of the container 10 controls the leaking.

Turning to FIG. 2, the container 10 has the outer layer 12, a cavity 50 to hold the vial 30, an absorbent/adsorbent material 16, and a first layer of a water-permeable material 14. The layers 12 and 14 are superimposed upon each other and seal together at the peripheral edges 66 of the container 10. At the peripheral edges 66, the layers 12, 14 are sealed together by conventional methods, such as heat sealing, pressure sealing, crimping, and/or adhesive. Between layers 12, 14 is the absorbent/adsorbent material 16. The absorbent/adsorbent material 16 is contained within the two layers 12, 14 until the liquid permeates through the first layer 14, which can dissolve or allow a liquid to penetrate therethrough.

The first layer 14 is any conventional water permeable material, such as starch paper, polyvinyl acetate, water-soluble synthetic polymer films, water soluble semisynthetic polymer films, and water-soluble natural polymers. Examples of water soluble synthetic polymer films include partially saponified polyvinyl alcohol, polyethers, such as polyethylene oxide and the like, polyvinylpyrrolidone, ethylenically unsaturated acids, such as acrylic acid, methacrylic acid, maleic acid, and polymers formed from their salts thereof.

Examples of water soluble semisynthetic polymer films include cellulose derivatives, such as carboxymethyl cellulose, hydroxyethyl cellulose, hydroxypropyl cellulose, and starch derivatives such as cyclodextrin. As for the water-soluble natural polymers, those include carrageena, starch, gelatin, and chitin.

Layer 14 can also be conventional non-woven and/or woven materials of plastic, natural products, namely, wool or cotton, or synthetic materials. In this embodiment, the layer 14 retains the position of the absorbent/adsorbent material 16 and allows liquid (not shown) to penetrate through it. In any case, liquid (not shown) passes through layer 14 when liquid (not shown) contacts it. The absorbent/adsorbent material 16 is then released. When released, the material 16 absorbs and/or immobilizes large volumes of aqueous solutions including dilute alkalis, dilute acids and body fluids. The material is, in some samples, sodium polyacrylate having the formula (C3H3O2Na)n and variations thereof. It is obtainable under the trademark WATER LOCK J-550 from Grain Processing Corporation. Other similar material 16 can used from Gelock, Inc. of Ohio.

In some instances, it is desirable to add a conventional nullifying agent 18, such as a biocide or equivalent thereof, to nullify a specific undesirable quality of the liquid (not shown). In some instances, it is desirable to mix the absorbent/adsorbent material 16 and nullifying agent 18 together as shown in FIG. 3.

Figure 4:
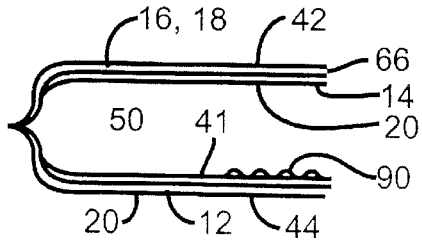

In another embodiment of the present invention, a second water permeable material 20 is located between the first layer 14 and the outer layer 12. The second layer 20 is selected from the same group of materials as the first layer 14. Moreover, the first layer 14 superimposes upon the second layer 20 and the outer layer 12, wherein each layer 12, 14, 20 seals together at the peripheral edges 66. As shown in FIG. 4, the absorbent/adsorbent material 16 and nullifying agent 18 are mixed together between the first and second layers 14, 20.

Figure 5:
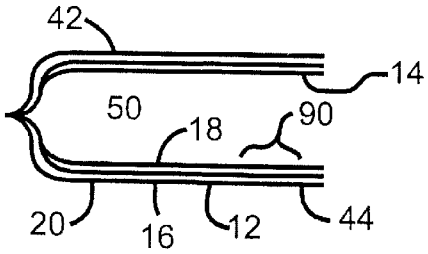

To ensure safe transport of the liquid (not shown), sometimes it is advisable to separate the two materials 16, 18. In FIG. 5, the nullifying agent 18 is between the first layer 14 and the second layer 16 while the absorbent/adsorbent material 16 is between the second layer 16 and the outer layer 12. In contrast, FIG. 6 shows the opposite configuration of FIG. 5.

Figure 6:
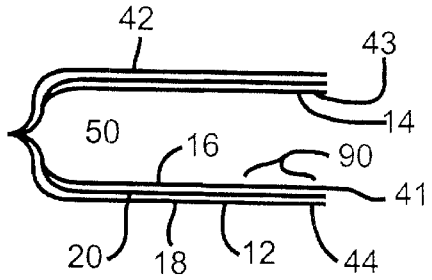
Figure 8:
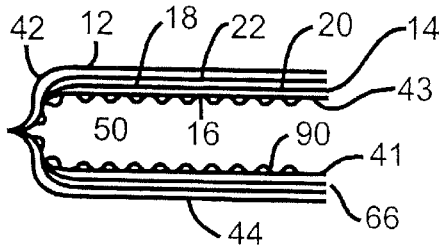
Figure 7:
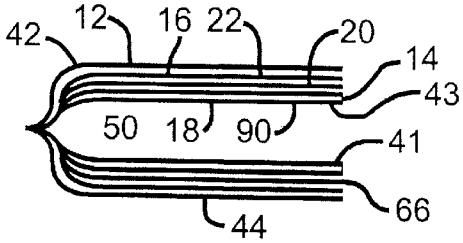

In yet another embodiment of the present invention, FIGS. 7 and 8 illustrate a variation of FIGS. 5 and 6 respectively. The only difference between these figures is that FIGS. 7 and 8 both illustrate a third water permeable material 22. The third layer 22 is selected from the same group of materials as the first layer 14. Moreover, the first layer 14 superimposes upon the second layer 20, third layer 22, and outer layer 12, wherein each interior layer 12, 14, 22, 20 seals together at the peripheral edges 66.

Figure 9:
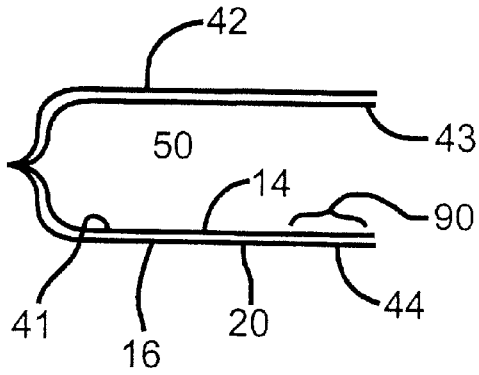

Another embodiment of the present invention is illustrated in FIG. 9. FIG. 9 illustrates FIG. 4 without the water insoluble layer 12. Obviously, as indicated by FIG. 9, alternative embodiments of the present invention also include those embodiments shown in FIGS. 4–8 without the water insoluble layer 22.

Likewise, FIGS. 10 and 11 respectively illustrate embodiments of FIGS. 2 and 9 without any sealing material 90. These embodiments can be sealed, for example by crimping or heat sealing. Obviously, as indicated by FIGS. 10 and 11, alternative embodiments of the present invention also include those embodiments illustrated in FIGS. 3–8.

Figure 12:
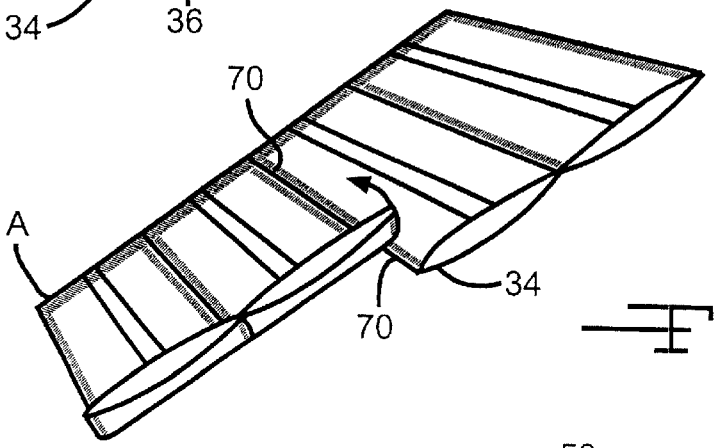
FIGS. 3 to 18 are alternative embodiments of FIG. 2.
Figure 13:
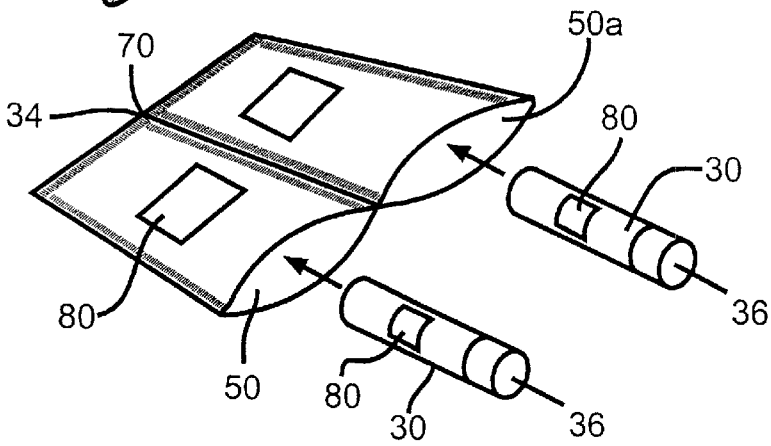

Turning to FIG. 1, packages 10 can be removed from roll 9 in sets, as shown in FIGS. 12 and 13, or individually, as shown in FIG. 9, along perforations 70. Thereby, the user can select the desired number of packages 10 to be transported.

Turning to FIGS. 13 and 16, vials 30 are inserted into cavity 50, preferably within an air pocket therein to provide further protection. The air pocket can be incorporated within cavity 50 by normal insertion of the vial into the cavity 50, or by a conventional blower 801. The blower pumps air into the cavity 50 to form the air pocket. The air pocket forms within the cavity 50 only after the package 10 is sealed as shown in FIG. 17*a*.

Turning to FIG. 1, alternatively, the package 10 and/or vial 30 can have a security feature 80. The security feature 80 can be a bar code system or illustrate the fingerprint, handprint, or thumbprint of the person who supplied the liquid (not shown) and/or who obtained the liquid (not shown). Preferably, the security feature 80 is positioned on the outer layer, 12, 22, or 20 of the package 10, on the vial 30, or both.

The security feature 80 can also be an identification feature, which identifies the type of test to be conducted on the liquid (not shown); and/or identifies who supplied the liquid (not shown) or where the liquid (not shown) came from.

Another alternative to the identification system can be a color code system. A particular color on the outer layer 12, 22, 20 of the package 10, the vial, 30, or both which identifies which test should be conducted on the liquid (not shown). The color can cover the entire outer layer 12, 22, 20, the vial 30, or both or just a portion thereof.

In case the absorbent/adsorbent material 16 is activated and absorbs/adsorbs the liquid (not shown), the liquid (not shown) can be extracted from the absorbent/adsorbent material 16, and the nullifying agent 18. The extraction can be accomplished by conventional biological processes, for example, osmosis, chemical processes, or mechanical processes, i.e., centrifugation. Thereby, the liquid (not shown) can be analyzed whether the vial 30 is broken or not. In yet another embodiment of the present invention shown at FIG. 13, the package container 10 can be divided into having at least two cavities 50, 50*a* to hold two vials 30, 30*a*. The container 10 is divided, not always equally, along edge 34 and/or perforations 70. Edge 34 is formed in the same manner as the various layers of container 10 are joined at peripheral edge 66.

The present invention 10 ensures that if for any reason liquid (not shown) leaks from vial 30, the liquid (not shown) will permeate, and dissolve in some instances, at least a portion of the first layer 14 and contact the absorbent/adsorbent material 16 and/or nullifying agent 18 that completely surrounds the vial 30. And once the liquid passes through the first layer 14, the enclosed agent, either 16 and/or 18, will nullify and/or absorb/adsorb the liquid (not shown). Thereby, the handler of the packaging container 10 will know that no liquid (not shown) should accidently leak from it.

Alternative embodiments of the packaging system 10 are shown in the following embodiments thereof.

Figure 18A:
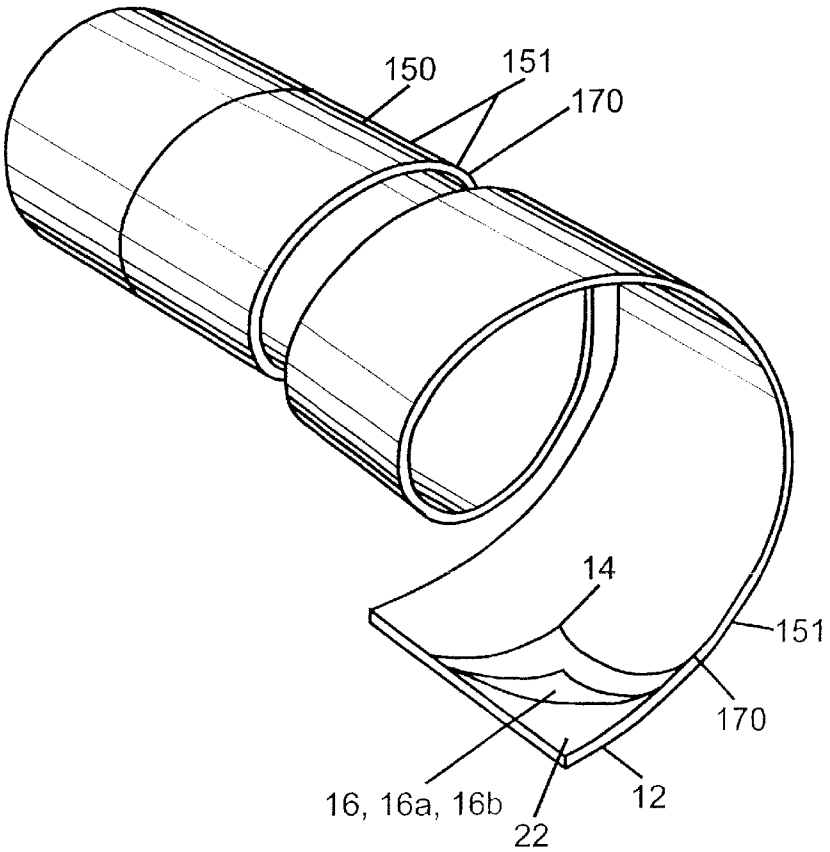
FIG. 18*a* is an exploded view of FIG. 18 of element 150.
Figure 18:
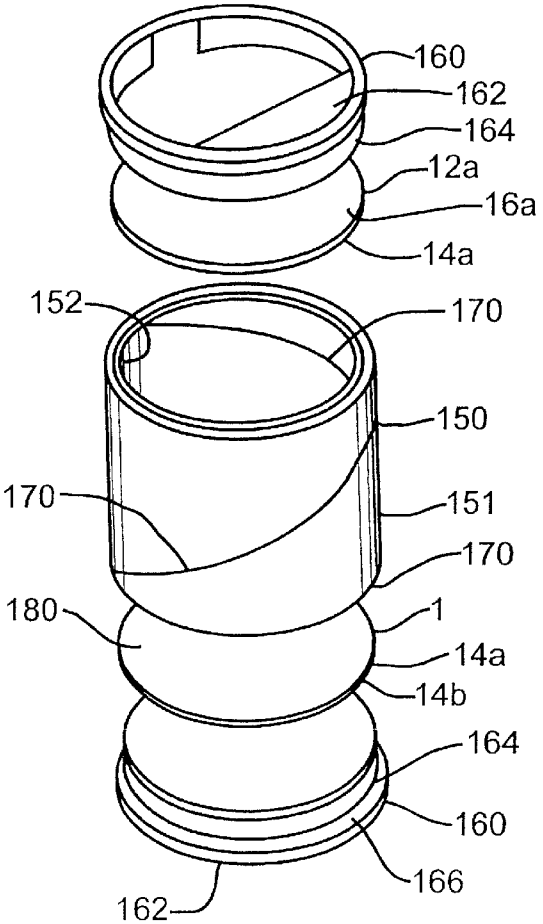

In FIGS. 18 and 18*a*, a packaging system 10 having at least one lid 160 and a packaging container 150 with at least one exterior side 151. The packaging container 150 has a first layer of a water permeable material 14 and a first water impermeable material 12. The inner layer of the packaging container 150 is the first water permeable material 14 and the outer layer of the packaging container is the first water impermeable material 12. The first water impermeable material 14 and the first water impermeable material 12 are sealed together at the peripheral edges 170 of the exterior side 151. A first absorbent/adsorbent material 16 is positioned between the first water permeable material 14 and first water impermeable material 12 and absorbs/adsorbs, depending on the material used therein, and immobilizes any liquid material that leaks from a vial (not shown) that is transported within the container 10.

The lid secures to the packaging container 150 by conventional means such as a snap lid as shown in Figure 18, or a screw lid, an indent lid, and an overlay lid (along with an indent lid). The snap lid 160 is comprised basically of a circular member 162 that has a diameter greater than the open end 152 defined by upper edge 154 and downwardly depending circular member 164 having a diameter approximating the diameter of the inner surface of cylinder 150 so that the lid 160 can snap into frictional engagement with the inner surface of the cylinder. When the outer edge 166 of member 162 engages the upper edge, the container is sealed.

Between the lid 160 and the packaging container 150 is a second absorbent/adsorbent material 16*a* (same or different material than element 16) positioned between a second water permeable material 14*a* (same or different material than element 14) and a second water impermeable material 12*a* (same or different material than element 12) that absorbs/adsorbs and immobilizes the liquid material that leaks from a vial (not shown).

In one embodiment, as illustrated in FIG. 18, the second water impermeable material 12*a* and the second water impermeable material 14*a* are sealed together with the absorbent/adsorbent material 16*a* contained within, at the peripheral edges of the at least one lid. In yet another embodiment, as illustrated in FIG. 18, the second water impermeable material 14*a* and a third water impermeable material 14*b* are sealed together with the absorbent/adsorbent material 16*a* contained within. This embodiment is then placed between the vessel (not shown) and the lid 160.

Figure 19A:
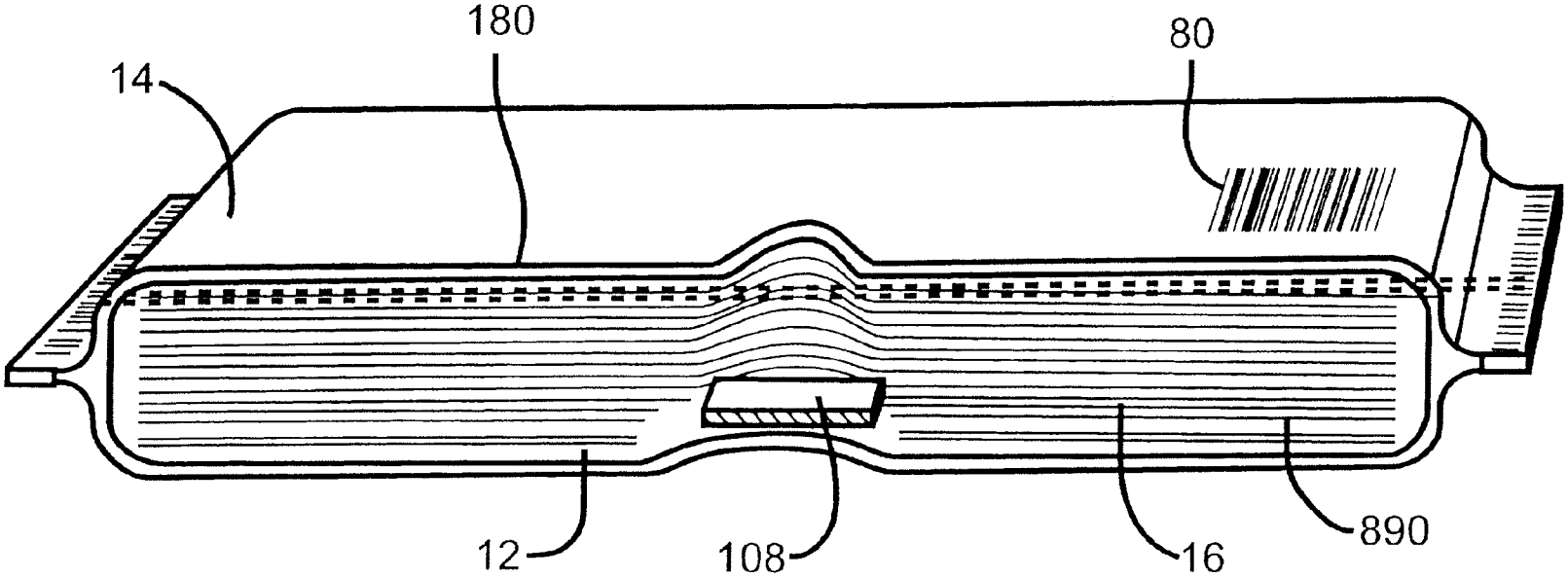
FIGS. 19*a* and 19*b* show alternative structures of the absorbent/adsorbent material 16 and alternative uses thereof.

Turning to FIG. 19*a*, the absorbent/adsorbent material 16, 16*a*, and/or 16*b*, is planar in relation to the outer layer 12.

Figure 19B:
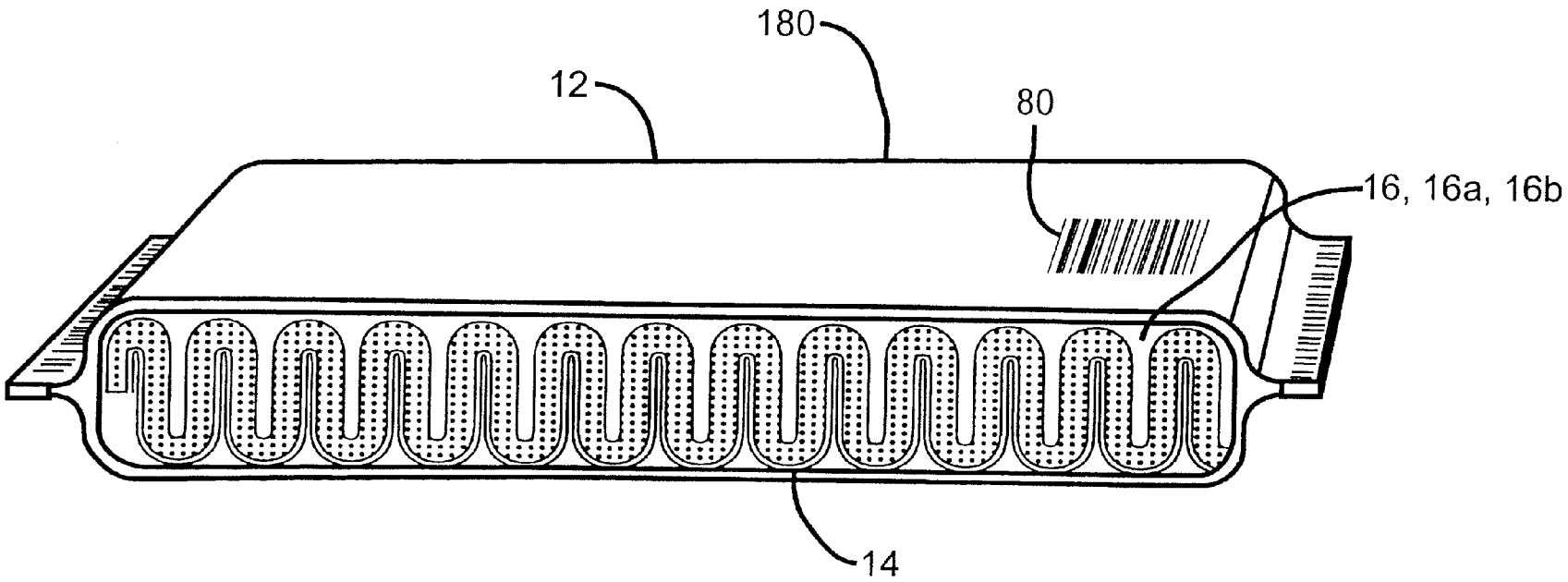

Turning to FIG. 19*b*, the absorbent/adsorbent material 16, 16*a*, 16*b*, can be corrugated or attached to a material which is corrugated. Obviously, the embodiments illustrated in FIGS. 1–16 can have the absorbent/adsorbent material 16, 16*a*, 16*b*, be corrugated in some way or manner, or planar. The shape of the absorbent/adsorbent material 16, 16*a*, 16*b* depends on the configuration and amount of absorbent/adsorbent material 16, 16*a*, 16*b* needed. For example, the corrugated style provides greater absorbency/adsorbency due to the increased surface area to collect the liquid.

FIG. 19*b* illustrates an absorbent/adsorbent pad 180. The difference with this pad 180 is that it has a sealable multilayer film having at least a first layer of a water permeable material 14 and at least one layer of a water insoluble material 12. The water insoluble material 12 and water permeable material 14 are superimposed and bonded to each other at the peripheral edges 66 of each material. The water permeable material 14 allows a liquid to penetrate through the first layer 14 when the pad 180 is applied to a liquid material. Between each material 12, 14 is a corrugated absorbent/adsorbent material 16 that absorbs/adsorbs and immobilizes the liquid material.

An alternative embodiment of FIG. 19*b* is FIG. 19*a*. This embodiment illustrates pad 180 having the same elements as FIG. 19*b* except a multi-layered absorbent/adsorbent material 16 and a second absorbent/adsorbent material 890 which is commonly used within the medical industry, i.e., cotton, is used. This multi-layered material 16–890, obviously can be used in the embodiments illustrated in FIGS. 1–17, and maximizes the absorbency/adsorbency of the liquid. The pads 180 illustrated in FIGS. 19*a* and 19*b* can be used in medical, industrial, or hygienical applications. Alternatively, the pads 180 and containers 10 may have identifiers 80, described above, and transponders 108 incorporated in and/or thereon. The transponders are conventional units used to identify the pad 180 or container 10. The transponders 108 can also contain information about the material 180, 10, i.e., initial weight, and help locate the material 180, 10 if it is lost. Such transponders 180 are conventional tools known to those skilled in the art. Such as those transponders disclosed in U.S. Pat. Nos. 4,658,818, 5,725,578, and 5,726,630, which are hereby incorporated by reference herein.

Figure 20:
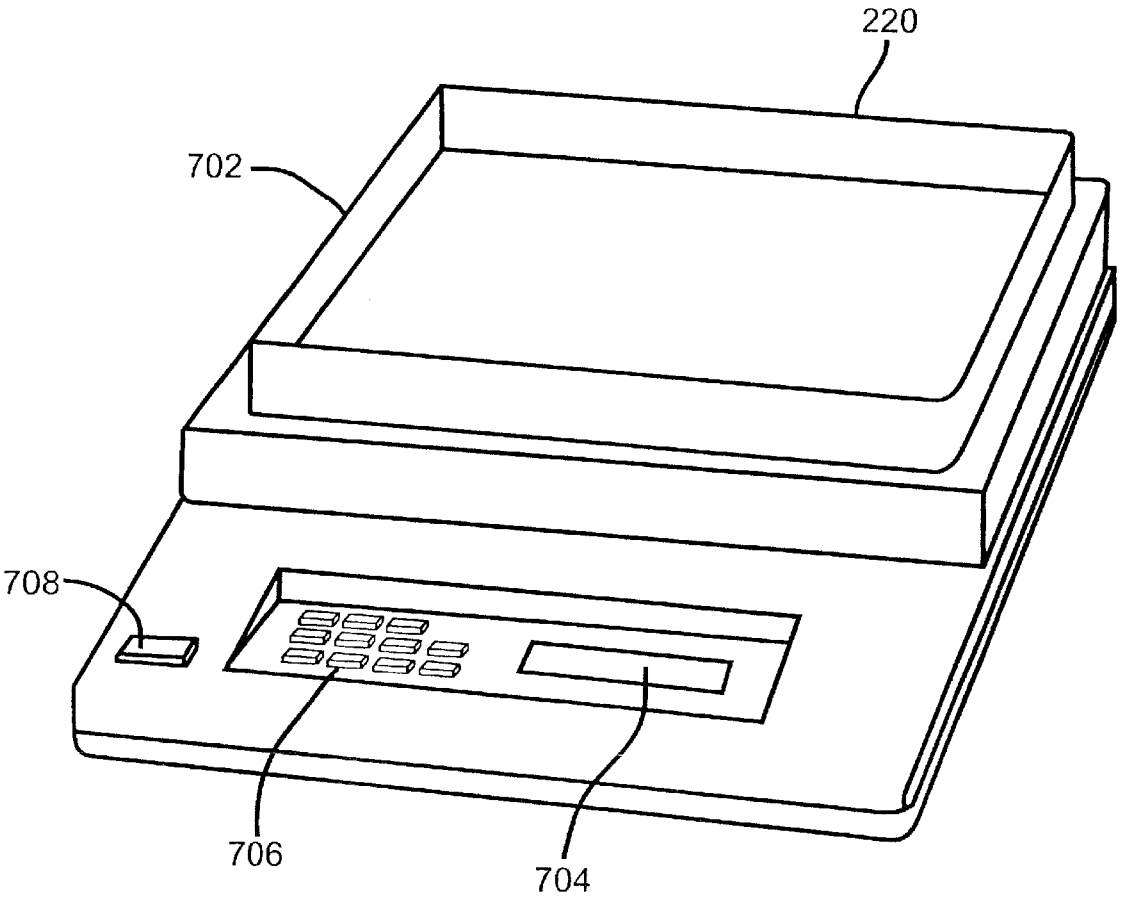
FIG. 20 is a scale for the present invention.

With a transponder 180 and/or identifier 80, the technician who receives the pad 180 or container 10 would be able to determine the weight of the fluid that the adsorbent/adsorbent material 16 immobilized. The technician would place the material 180, 10 onto a scale 700, in particular a tray 702, as shown in FIG. 20. The scale 700 has a conventional digital unit with a display output 704. The scale 700 would also have an input keypad 706 to enter the information set forth in the identifier 80, and/or a conventional bar code/ transponder reader 708 that would read the bar code from identifier 80 or transponder 180. With such information, the scale 700 should tare the material 10, 180. Hence, the amount of liquid contained in the material 10, 180 would be known.

This information would assist industrial and medical technicians know how much liquid has spilled from the industrial container or come from a human being.

Figure 21:
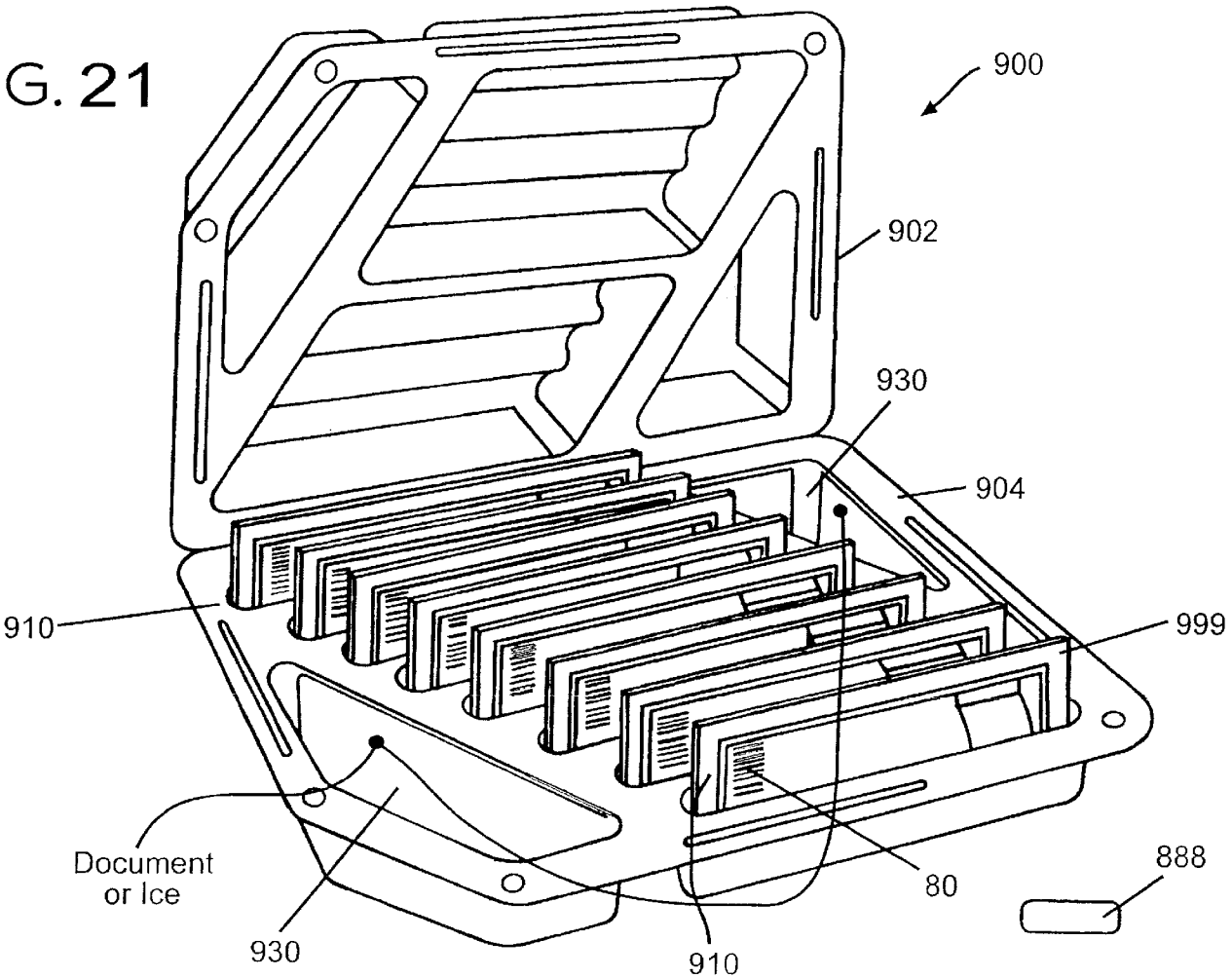
FIG. 21 is a shipping container for FIGS. 1–17 and other articles thereof.

Turning to FIG. 21, a shipping container 900 is shown. The container 900 has a top section 902 hinged to a bottom section 904. The bottom section 904 has a plurality of slots 910 that receive container 10, 180 or any other instrument having a bar code identifier 80 thereon (hereinafter collectively referred to as "Material 999"). Each slot 910 is staggered from the other slot 910 so the bar code identifier 80 of each Material 999 within the slots 910 is visible. The top section 902 has a corresponding structure to receive the Material 999. Alternatively, the container 900 can have storage compartments 930 to store documents or other instruments thereof.

When a technician receives the container 900, the technician opens the container 900 and can read each bar code identifier 80 of Material 999 with a conventional bar code reader (not shown) without removing the Material 999 from the container 900.

With this embodiment, the technician will avoid unnecessary contact with the Material 999. Thereby, whatever is contained within the Material 999 has a less chance of being contaminated or damaged by a technician.

While preferred embodiments of the present invention have been disclosed, it will be appreciated that it is not limited thereto but may be otherwise embodied with the scope of the following claims.

I claim:

1. A container useful to transport a liquid comprising:

a spiral-wound wall having an exterior surface, at least one open end, an interior surface wherein the interior surface defines a portion of a boundary of a cavity;

a super-absorbent lining adhered to the interior surface in a sufficient amount to convert the liquid into a gel-like state when the liquid comes in contact therewith;

a closure lid impermeable to fluids and frictionally engaged with the container for closing the open end.

2. The container of claim 1 wherein the lid is frictionally engaged with the container by first threads on the wall adjacent the open end and matching second threads on the closure lid.

3. The container of claim 1 wherein the lid is frictionally engaged with the container by at least one rib nesting within a groove.

4. The container of claim 1 wherein the lid is frictionally engaged with the container by a friction fit between the wall and the closure lid.

5. The container of claim 1 wherein the super-absorbent material is polyacrylate.

6. The container of claim 1 wherein the liquid is contained within a vial.

7. The container of claim 1 wherein the spiral-wound wall is cylindrical.

8. A container useful to transport a liquid comprising:

a spiral-wound wall having an exterior surface, at least one open end, an interior surface wherein the interior surface defines a portion of a boundary of a cavity;

a super-absorbent lining adhered to the interior surface in a sufficient amount to convert the liquid into a gel-like state when the liquid comes in contact therewith;

the open end communicating with the cavity through which the liquid is introduced;

a closure lid impermeable to fluids and frictionally engaged with the container for closing the open end.

9. The container of claim 8 wherein the lid is frictionally engaged with the container by first threads on the wall adjacent the open end and matching second thread on the closure lid.

10. The container of claim 8 wherein the lid is frictionally engaged with the container by at least one rib nesting within a groove.

11. The container of claim 8 wherein the lid is frictionally engaged with the container by a friction fit between the wall and the closure lid.

12. The container of claim 8 wherein the super-absorbent material is polyacrylate.

13. The container of claim 8 wherein the liquid is contained within a vial.

14. The container of claim 8 wherein an upper edge defines the open end and the closure lid comprises:

a planar member sufficient in area to cover the open end;

a circular member extending downwardly from the planar member and having a friction fit with the wall when the planar member is in engagement with the upper edge.

15. The container of claim 8 wherein the spiral-wound wall is cylindrical.

16. A container useful to transport a liquid comprising:

a cylindrical wall having an exterior surface that is impermeable to fluids, at least one open end, an interior surface wherein the interior surface defines a portion of a boundary of a cavity;

a super-absorbent lining adhered to the interior surface in a sufficient amount to convert the liquid into a gel-like state when the liquid comes in contact therewith a closure lid impermeable to fluids and frictionally engaged with the container for closing the open end.

17. The container of claim 16 wherein the lid is frictionally engaged with the container by first threads on the wall adjacent the open end and matching second threads on the closure lid.

18. The container of claim 16 wherein the lid is frictionally engaged with the container by at least one rib nesting within a groove.

19. The container of claim 16 wherein the lid is frictionally engaged with the container by a friction fit between the wall and the closure lid.

20. The container of claim 16 wherein the super-absorbent material is polyacrylate.

21. The container of claim 16 wherein the liquid is contained within a vial.

22. A container useful to transport a liquid comprising:

a cylindrical wall having an exterior surface that is impermeable to fluids, at least one open end, an interior surface wherein the interior surface defines a portion of a boundary of a cavity;

a super-absorbent lining adhered to the interior surface in a sufficient amount to convert the liquid into a gel-like state when the liquid comes in contact therewith;

the open end communicating with the cavity through which the liquid is introduced;

a closure lid impermeable to fluids and frictionally engaged with the container for closing the open end.

23. The container of claim 22 wherein the lid is frictionally engaged with the container by first threads on the wall adjacent the open end and matching second threads on the closure lid.

24. The container of claim 22 wherein the lid is frictionally engaged with the container by at least one rib nesting within a groove.

25. The container of claim 22 wherein the lid is frictionally engaged with the container by a friction fit between the wall and the closure lid.

26. The container of claim 22 wherein the super-absorbent material is polyacrylate.

27. The container of claim 22 wherein the liquid is contained within a vial.

28. The container of claim 22 wherein an upper edge defines the open end and the closure lid comprises:

a planar member sufficient in area to cover the open end;

a circular member extending downwardly from the planar member and having a friction fit with the interior surface to complete a seal when the planar member is in engagement with the upper edge.

* * * * *

UNITED STATES PATENT AND TRADEMARK OFFICE

CERTIFICATE OF CORRECTION

PATENT NO. : 6,523,681 B1
DATED : February 25, 2003
INVENTOR(S) : Hacikyan

It is certified that error appears in the above-identified patent and that said Letters Patent is hereby corrected as shown below:

Title page,
Item [54], please delete the title "ABSORBENT/ADSORBENT PADS"
and insert -- TRANSPORT CONTAINER --.

Signed and Sealed this

Twenty-second Day of July, 2003

JAMES E. ROGAN
*Director of the United States Patent and Trademark Office*